US008607750B2

(12) United States Patent
Parsche

(10) Patent No.: US 8,607,750 B2
(45) Date of Patent: Dec. 17, 2013

(54) DEVICE FOR VARYING THE CHARGE-CHANGING VALVE LIFT IN AN INTERNAL COMBUSTION ENGINE

(75) Inventor: Uwe Parsche, Chemnitz (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 51 days.

(21) Appl. No.: 13/471,509

(22) Filed: May 15, 2012

(65) Prior Publication Data

US 2012/0291731 A1 Nov. 22, 2012

(30) Foreign Application Priority Data

May 16, 2011 (DE) ..... 10 2011 101 868

(51) Int. Cl.
*F01L 1/34* (2006.01)

(52) U.S. Cl.
USPC ..... 123/90.16; 123/90.15; 74/569

(58) Field of Classification Search
USPC ..... 123/90.16, 90.15, 90.24; 74/569
See application file for complete search history.

(56) References Cited

U.S. PATENT DOCUMENTS

| | | | | |
|---|---|---|---|---|
| 4,151,817 | A | 5/1979 | Mueller | |
| 4,353,334 | A | 10/1982 | Neitz | |
| 4,354,460 | A | 10/1982 | Mae et al. | |
| 4,516,542 | A | 5/1985 | Aoyoma et al. | |
| 4,534,323 | A | 8/1985 | Kato et al. | |
| 6,915,768 | B2 | 7/2005 | Ohsawa | |
| 2007/0204819 | A1 * | 9/2007 | Elendt et al. | 123/90.16 |
| 2008/0236531 | A1 | 10/2008 | Yamamoto et al. | |
| 2010/0242884 | A1 | 9/2010 | Meintschel et al. | |
| 2010/0251982 | A1 | 10/2010 | Elendt et al. | |

FOREIGN PATENT DOCUMENTS

| | | | |
|---|---|---|---|
| DE | 4230877 | A1 | 4/1993 |
| DE | 19520117 | A1 | 12/1996 |
| DE | 19700736 | A1 | 7/1998 |
| DE | 102004022849 | A1 | 12/2005 |
| DE | 102004056290 | A1 | 6/2006 |
| DE | 102007054978 | A1 | 5/2009 |
| DE | 102009007263 | A1 | 8/2010 |
| DE | 102010013216 | A1 | 10/2010 |
| EP | 2196638 | A1 | 6/2010 |
| JP | 55131515 | A | 10/1980 |
| JP | 2003003811 | A | 1/2003 |
| JP | 2005155555 | A | 6/2005 |

* cited by examiner

*Primary Examiner* — Zelalem Eshete
(74) *Attorney, Agent, or Firm* — Leydig, Voit & Mayer, Ltd.

(57) ABSTRACT

A device for varying charge-changing valve lift in an internal combustion engine includes a camshaft and a cam carrier disposed on the camshaft. A plurality of different cam profiles are disposed on the cam carrier. An adjusting shaft is disposed parallel to the camshaft. A first transmission element including a guide path is disposed non-rotatably and axially displaceably on the adjusting shaft. A first engagement element is connected in a stationary manner to a housing of the internal combustion engine and is configured to be guided along the guide path via rotation of the adjusting shaft. A second engagement element is disposed on a second transmission element and is configured to be guided along the guide path via rotation of the adjusting shaft. The second transmission element is connected to the cam carrier so as to axially displace the cam carrier along the camshaft.

7 Claims, 2 Drawing Sheets

360°
270°
180°
90°
0°
5
6
6a
6b
7
9
h
h0

DEVICE FOR VARYING THE CHARGE-CHANGING VALVE LIFT IN AN INTERNAL COMBUSTION ENGINE

CROSS-REFERENCE TO PRIOR APPLICATION

Priority is claimed to German Patent Application No. DE 10 2011 101 868.2, filed on May 16, 2011, the entire disclosure of which is hereby incorporated by reference herein.

FIELD

The present invention relates to a device for varying the charge-changing valve lift in an internal combustion engine.

BACKGROUND

To vary the charge-changing valve lift in an internal combustion engine, a cam carrier, which is axially displaceably arranged on the camshaft and has at least two different cam profiles can be provided. EP 2196638B1 describes adjusting shaft arranged parallel to the camshaft to displace a cam carrier on the camshaft of an internal combustion engine. A shift gate is axially displaceably arranged on the adjusting shaft. The shift gate and the adjusting shaft are not non-rotatably connected to one another. The shift gate comprises a gate groove which widens counter to the rotational direction of the camshaft and can be made to engage with a pin rigidly arranged on the cam carrier. The shift gate is then made to engage with the pin when the shift gate is axially displaced. The shift gate is axially displaced in that the adjusting shaft is rotated and two pegs non-rotatably connected to the adjusting shaft are guided along on two contour elements, which are arranged in the axial direction on the switch gate on the end faces thereof in such a way that a lift movement is carried out in the direction of the axial extent of the regulating shaft. When the pin engages in the gate groove, the cam carrier is axially displaced and a changeover of the valve lift takes place. The shift gate partially encompasses the camshaft and thus needs a great deal of installation space.

SUMMARY

In an embodiment, the present invention provides a device for varying charge-changing valve lift in an internal combustion engine. The device includes a camshaft and a cam carrier disposed on the camshaft. A plurality of different cam profiles are disposed on the cam carrier and configured to be brought into operative connection with charge-changing valves so as to vary the charge-changing valve lift of the charge-changing valves. An adjusting shaft is disposed parallel to the camshaft. A first transmission element including a guide path is disposed non-rotatably and axially displaceably on the adjusting shaft. A first engagement element is connected in a stationary manner to a housing of the internal combustion engine and is configured to be guided along the guide path via rotation of the adjusting shaft. A second engagement element is disposed on a second transmission element and is configured to be guided along the guide path via rotation of the adjusting shaft. The second transmission element is connected to the cam carrier so as to axially displace the cam carrier along the camshaft.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
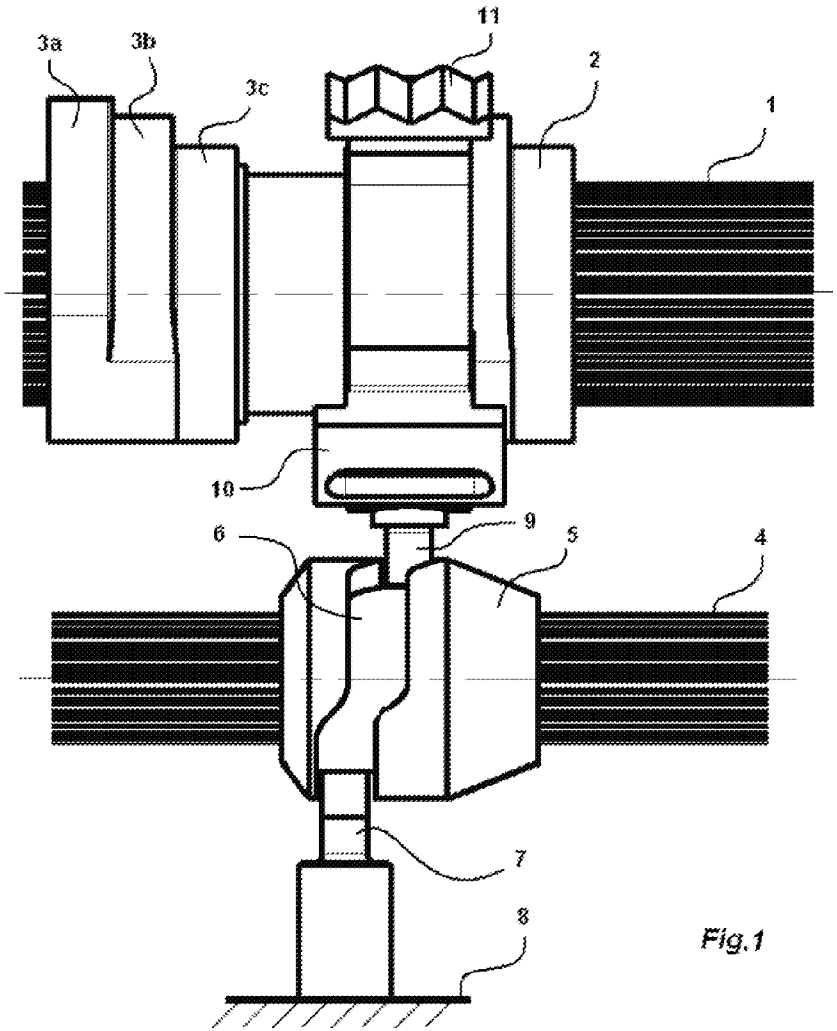
FIG. 1 shows a schematic view of the device according to an embodiment the invention.

In an embodiment, the present invention configures the axial displacement of a cam carrier on the camshaft with more compact means. This configuration is achieved according to an embodiment of the invention in that an adjusting shaft is arranged parallel to the camshaft for the axial displacement of a cam carrier on the camshaft of an internal combustion engine and in that a first transmission element having a guide path is non-rotatably, but axially displaceably, arranged on the adjusting shaft and in that upon rotation of the adjusting shaft, a first engagement element that is connected in a stationary manner to the housing of the internal combustion engine is guided along the guide path and in that upon rotation of the adjusting shaft, a second engagement element that is arranged on a second transmission element for the axial displacement of the cam carrier is guided along the guide path. Thus, according to an embodiment, it is provided that, in order to change over between a plurality of available cam profiles, an adjusting shaft is arranged on the camshaft of an internal combustion engine to actuate one or more charge-changing valves of a cylinder, parallel to the camshaft, on which adjusting shaft there is arranged, non-rotatably, but axially displaceably, a first transmission element having a guide path and in that on rotation of the adjusting shaft, a first engagement element that is connected in a stationary manner to the housing of the internal combustion engine is guided along the guide path and in that upon rotation of the adjusting shaft, a second engagement element that is arranged on a second transmission element to change over between the available cam profiles on the camshaft is guided along the guide path. The second transmission element preferably cooperates with an axially displaceable cam carrier having a plurality of cam profiles. The second transmission element may, however, also be configured as a lever, for example as a cam follower or rocker arm, which can be axially displaced on a camshaft to change over between the available cam profiles, as discussed, for example in U.S. Pat. No. 4,534,323. Since the first engagement element is arranged in a stationary manner in the housing of the internal combustion engine and the second engagement element is connected to the second transmission element and the first and the second engagement element are linked to one another by a guide path, an extremely compact structural shape is achieved. In addition, the guide path may be flexibly configured according to an embodiment of the invention, so advantageous effects on the axial displacement of the cam carrier or the number of selectable and switchable cam profiles are produced. Thus, depending on the configuration of the guide path, an increase in the achievable axial displacement path of the cam carrier can be achieved with the same rotational angle of the adjusting shaft. In particular, the guide path may be configured in such a way that, upon a rotation of the adjusting shaft, the axial displacement of the first transmission element relative to the housing of the internal combustion element and the axial displacement of the second transmission element relative to the first transmission element are added together.

Furthermore, the regions of the guide path required for the axial displacement of the cam carrier, which have a slope, may be flatter as a result of the first and second engagement element being linked by only one guide path, so the forces between the components involved can be minimised.

As shown in FIG. 1, an internal combustion engine comprises a camshaft 1. The camshaft 1 has a profiling at its outer periphery, so a sleeve-shaped cam carrier 2, which also has a corresponding profiling on its inner periphery, is non-rotatably, but axially displaceably, arranged on the camshaft 1. The cam carrier 2 comprises a plurality of cam profiles 3*a* to 3*c*, which are in operative connection with charge-changing valves. An adjusting shaft 4 is arranged parallel to the camshaft 1. The adjusting shaft 4 has a profiling at its outer periphery, so a sleeve-shaped first transmission element 5, which also has a corresponding profile on its inner periphery, is non-rotatably, but axially displaceably, arranged on the adjusting shaft 4. The first transmission element 5, on its outer periphery, has a peripheral, self-contained groove or a guide path 6. A pin is guided as a first engagement element 7 in the guide path 6. The first engagement element 7 is connected in a stationary manner to the housing 8 of the internal combustion engine. A pin is furthermore guided as a second engagement element 9 in the guide path 6. The second engagement element 9 is in operative connection with a second transmission element 10 in that it is rigidly arranged on the second transmission element 10. The second transmission element 10 may, for example, be a roller bearing for mounting the camshaft 1 or the cam carrier 2, on the outer ring of which the second engagement element 9 is arranged. The inner ring of this roller bearing is, in this case, non-rotatably connected to the cam carrier 2. The outer ring of the roller bearing is arranged in a fitting bore in the housing 8 of the internal combustion engine in such a way that an axial displacement of the outer ring is possible. The entire roller bearing and hence the cam carrier 2, can therefore be displaced by an axial force, which acts on the second engagement element 9, in the axial direction of the camshaft 1 in relation to the housing 8 of the internal combustion engine. To lock the cam carrier 2 in discrete axial positions, arranged on the second transmission element 10 are recesses 11, in which spring-loaded balls can in turn engage. To change over between the three cam profiles 3*a* to 3*c*, i.e. a specific axial displacement of the cam carrier 2, the adjusting shaft 4, and therefore the first transmission element 5, are rotated about a specific angle. Since the first engagement element 7 is connected in a stationary manner to the housing 8 of the internal combustion engine and the second engagement element 9 is connected to the second transmission element 10, depending on the configuration of the guide path 6, upon rotation of the adjusting shaft 4, an axial displacement of the second transmission element 10 takes place relative to the housing 8 of the internal combustion engine and therefore an axial displacement of the cam carrier 2. The configuration of the guide path 6 may be flexible according to an embodiment of the invention. Thus, for the cam carrier 2 shown in FIG. 1 with three cam profiles 3*a* to 3*c*, the guide path 6 may be configured such that two shifting processes are possible in an axial direction of the cam carrier 2, for example coming from the cam profile 3*a*, to the cam profile 3*c* and back, i.e. four shifting positions in total per rotation of the adjusting shaft 4. Depending on the configuration of the guide path 6, an increase in the achievable axial displacement path of the cam carrier 2 can be achieved with the same rotational angle of the adjusting shaft 4 owing to the cooperation of the first engagement element 7, which is connected in a stationary manner to the housing 8 of the internal combustion engine, with the second engagement element 9 that is connected to the second transmission element 10. Moreover, the regions of the guide path 6 required for the axial displacement of the cam carrier 2, which have a slope, thus become flatter. The views in FIGS. 2*a* to 2*e* show these connections in detail. FIGS. 2*a* to 2*e* in this regard show a development of the periphery of the first transmission element 5 over a 360° rotational angle or a development of the guide path 6 for the four shifts, which are required according to the configuration in FIG. 1. The two engagement elements 7, 9 oppose one another directly here, i.e. they have an angle of 180° in relation to one another.

Figures 2A, 2B, 2C, 2D, 2E:
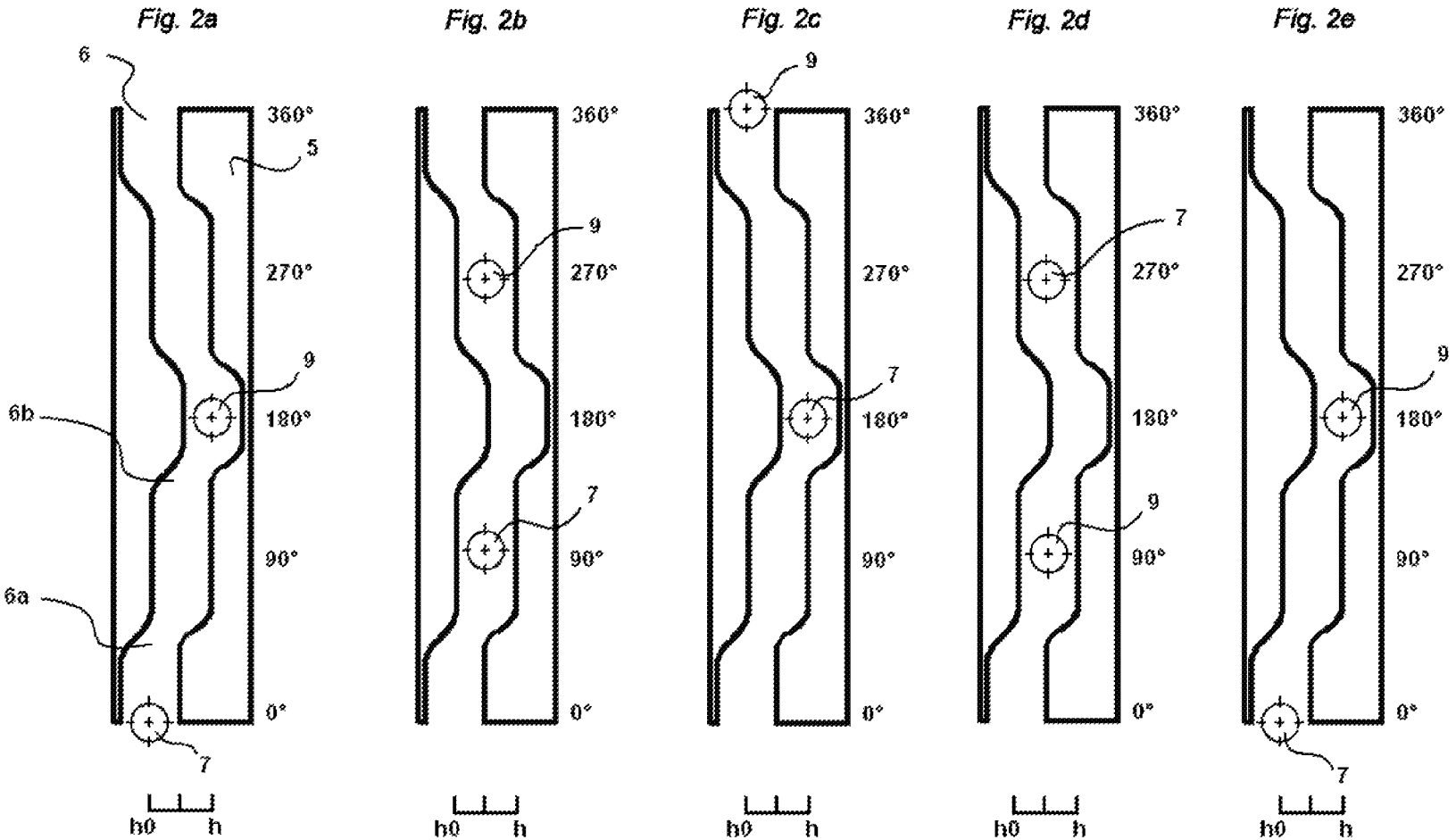
FIG. 2 shows a schematic view of individual phases of the cooperation of the first and second engagement element depending on the configuration of the guide path.

As shown in FIG. 2*a*, the relatively small lift of the first transmission element 5, which is produced in that the first transmission element 5 is rotated through 90° and is supported on the first engagement element 7 on the housing 8, and the guide path 6 has a first slope portion 6*a*, and the lift of the second transmission element 10, which is produced in that the first transmission element 5 is rotated and the guide path 6 has a further slope portion 6*b*, are added together according to an embodiment of the invention, starting from a zero lift h0 to the common lift h, i.e. owing to the rotation of the adjusting shaft 4, even if only one guide path 6 is used, an increased common lift h is produced, which is available for the axial displacement of the cam carrier 2. According to FIG. 2*a*, in other words, the position of the first transmission element 5 and the two engagement elements 7, 9 relative to one another is shown for the axial position of the cam carrier 2, in which the gas-changing valves have an operative connection to the lift profile 3*a*. To change over to the lift profile 3*b*, the first transmission element 5 is rotated through a further 90° in the same direction, so the first and second engagement elements 7, 9 adopt the positions in the guide path 6, as shown in FIG. 2*b*, and the axial displacement of the cam carrier 2 decreases by half compared to FIG. 2*a*, and so the cam profile 3*b* instead of the cam profile 3*a* has an operative connection to the gas-changing valves. Upon a further rotation of the adjusting shaft 4 through 90°, the second engagement element 9 is now displaced such that the lift profile 3*c* has an operative connection to the gas-changing valves, as shown in FIG. 2*c*. As the lift profile 3*c* only corresponds to the base circle of the two lift profiles 3*a* and 3*b*, the gas-changing valves in operative connection to the lift profile 3*c* are switched off. If the adjusting shaft is rotated through a further 90°, the second engagement element 9 is displaced such that the lift profile 3*b* again is in operative connection with the gas-changing valves, as shown in FIG. 2*d*. If the adjusting shaft is rotated through a further 90°, the second engagement element 9 is displaced such that the lift profile 3*a* again is in operative connection with the gas-changing valves, as shown in FIG. 2*e* or in 2*a*. Accordingly, a very compact device is formed according to an embodiment of the invention for the axial displacement of the cam carrier 2. As a result of the relatively flat slope portions 6*a*, 6*b* in the guide path 6, comparatively small contact forces occur according to an embodiment of the invention between the first transmission element 5 and the first and second engagement elements 7, 9. Furthermore, relatively large diameters of the respective first and second engagement elements 7, 9 configured, for example as a pin, can be realised. The wording that the first and the second engagement element are guided along the guide path 6 according to an embodiment of the invention is equivalent to the guide path 6 being a groove, which is incorporated on the periphery of the first transmission element 5 and the first and the second engagement element 7, 9 in each case engage in this groove and are guided in the groove, or equivalent to the guide path 6 being an elevation, which is arranged at the periphery of the first transmission element 5 and the first and the second engagement element 7, 9 in each case encompass this elevation and are guided by the elevation, i.e. the first and the second engagement element 7, 9 can in each case also be regarded as a surrounding element, which surrounds the elevation. The guide path 6 may also be arranged on the inner periphery of the first transmission element 5 if the latter has at least one part corresponding to a hollow cylinder and having an accessible inner periphery.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

What is claimed is:

1. A device for varying charge-changing valve lift in an internal combustion engine, the device comprising:

a camshaft;

a cam carrier disposed on the camshaft;

a plurality of different cam profiles disposed on the cam carrier and configured to be brought into operative connection with charge-changing valves so as to vary the charge-changing valve lift of the charge-changing valves;

an adjusting shaft disposed parallel to the camshaft;

a first transmission element including a guide path and disposed non-rotatably and axially displaceably on the adjusting shaft;

a first engagement element connected in a stationary manner to a housing of the internal combustion engine and configured to be guided along the guide path via rotation of the adjusting shaft; and a second engagement element disposed on a second transmission element and configured to be guided along the guide path via rotation of the adjusting shaft, the second transmission element being connected to the cam carrier so as to axially displace the cam carrier along the camshaft.

2. The device according to claim 1, wherein the guide path is a self-contained peripheral groove disposed in a periphery of the first transmission element, each of the first and the second engagement elements being engaged in and guided by the self-contained peripheral groove.

3. The device according to claim 1, wherein the guide path is an elevation disposed on a periphery of the first transmission element, each of the first and the second engagement element encompassing and being guided by the elevation.

4. The device according to claim 1, wherein the second transmission element is a bearing that mounts the camshaft and the cam carrier.

5. The device according to claim 4, wherein the bearing is a roller bearing including an inner ring and an outer ring, the inner ring being non-rotatably connected to the cam carrier and the outer ring being disposed in a fitting bore in the housing of the internal combustion engine so as to be axially displaceable, the second engagement element being disposed on the outer ring such that an axial force acting on the second engagement element axially displaces the roller bearing and the cam carrier in an axial direction of the camshaft relative to the housing of the internal combustion engine.

6. The device according to claim 1, wherein the guide path is disposed along a periphery of the first transmission element and is configured to provide a total axial displacement, via the rotation of the adjusting shaft, that corresponds to a sum of a first axial displacement of the first transmission element relative to the housing of the internal combustion engine and a second axial displacement of the second transmission element relative to the first transmission element.

7. The device according to claim 6, wherein the guide path configured to provide two axial displacement processes of the cam carrier respectively in a first direction along the camshaft and back in a second direction along the camshaft via the rotation of the adjusting shaft through a 360° angle of rotation.

* * * * *